United States Patent [19]

Kiejzik

[11] 4,003,187

[45] Jan. 18, 1977

[54] MICROFILM JACKET MICROFILM FEEDING DEVICE AND PROCESS

[76] Inventor: Paul A. Kiejzik, 2907 Monterey Court, Springfield, Pa. 19069

[22] Filed: Sept. 8, 1975

[21] Appl. No.: 611,004

[52] U.S. Cl. ..... 53/123; 53/187; 83/373; 83/589; 83/602

[51] Int. Cl.[2] ..... B65B 63/00; B65B 43/26

[58] Field of Search ..... 53/123, 187, 384, 125; 83/373, 589, 602

[56] References Cited

UNITED STATES PATENTS

| | | | |
|---|---|---|---|
| 2,779,408 | 1/1957 | Miller et al. | 83/373 X |
| 2,937,483 | 5/1960 | Engelstein | 53/123 |
| 3,019,579 | 2/1962 | Heckman | 53/123 |
| 3,457,697 | 7/1969 | Engelstein | 53/123 |
| 3,477,196 | 11/1969 | Lerner | 53/187 X |
| 3,500,709 | 3/1970 | Landman | 83/589 X |
| 3,872,645 | 3/1975 | Dorman | 53/123 |
| 3,896,603 | 7/1975 | Tout | 53/123 |

*Primary Examiner*—Travis S. McGehee
*Assistant Examiner*—Horace M. Culver

[57] ABSTRACT

In a preferred embodiment, there is provided a microfilm jacket support supportable of a flat microfilm jacket in a horizontal position in an anchored state with a leading edge of the jacket extending beyond the support when mounted thereon, and with a microfilm insertion opening into microfilm jacket reservoir space being positioned at the edge of the support face-up when mounted on the support, and as a part of the combination additionally there being an upper edge pressure-flexing mechanism for flexing downwardly the leading edge extending beyond the support adjacent the insertion opening, and a feeding mechanism for aligning a longitudinal elongated axis of the microfilm with a longitudinal elongated axis of the microfilm jacket reservoir space and with the insertion opening and for feeding advancingly intermittently microfilm into the insertion opening and for intermittently serving microfilm, and additionally for mounting in association with microfilm immediately adjacent the insertion opening a microfilm projection mechanism for viewing a microfilm frame about to be inserted.

9 Claims, 21 Drawing Figures

FIG. 4
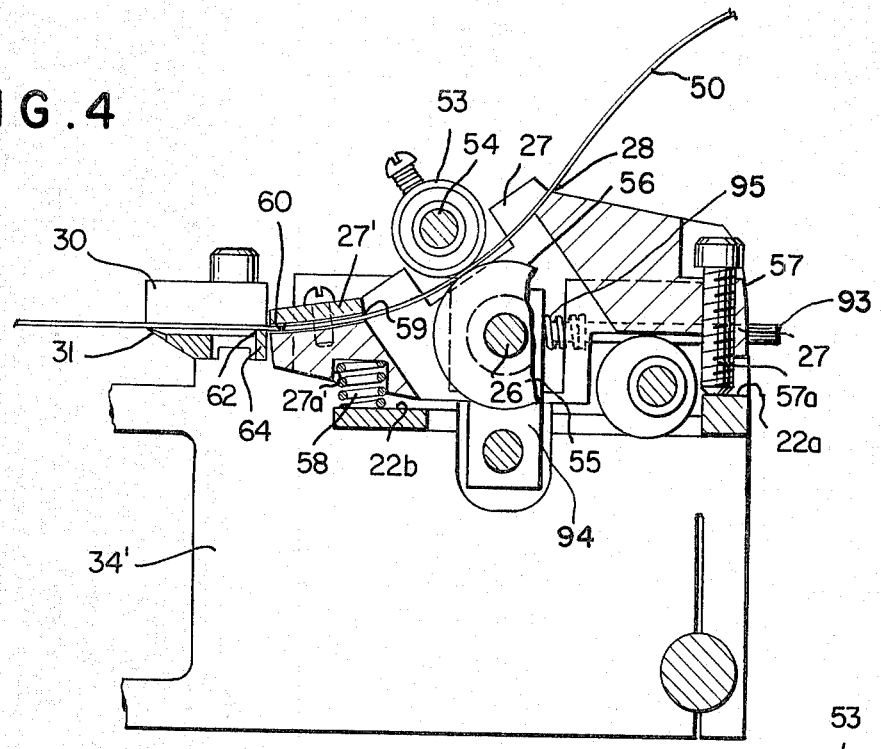
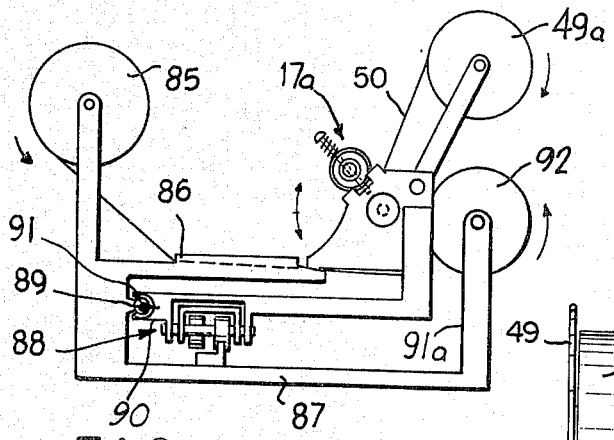
FIG. 1A
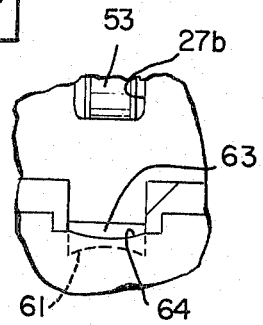
FIG. 5A
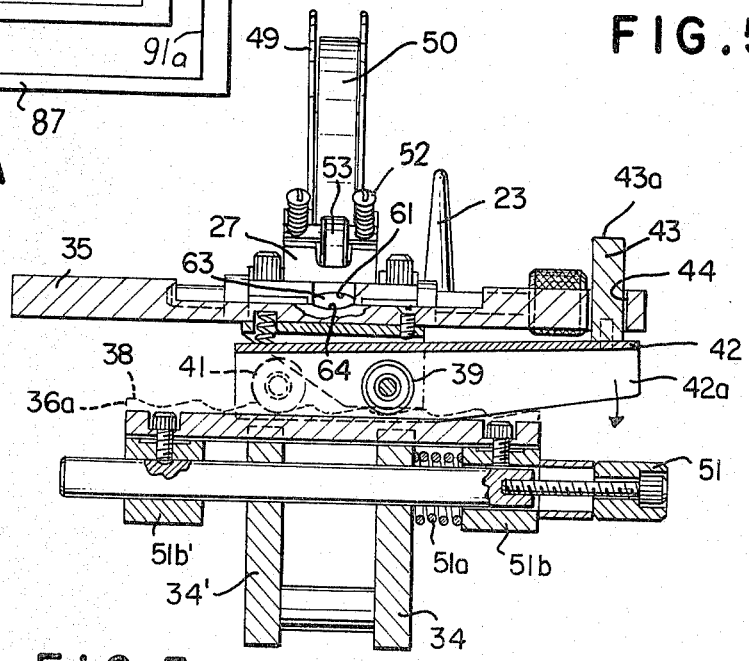
FIG. 5

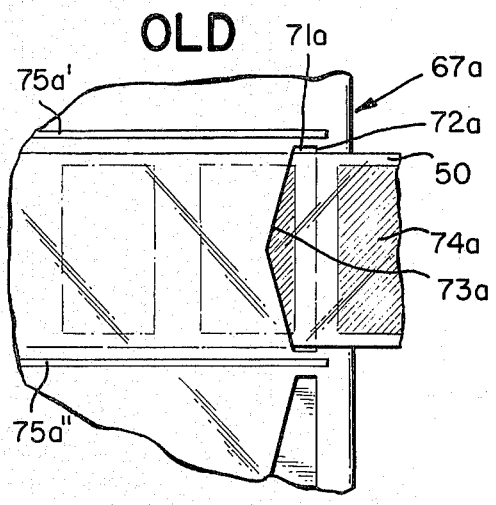
FIG. 8
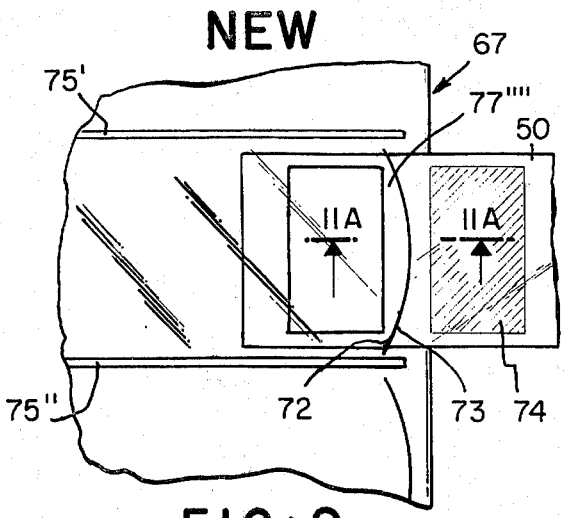
FIG. 9
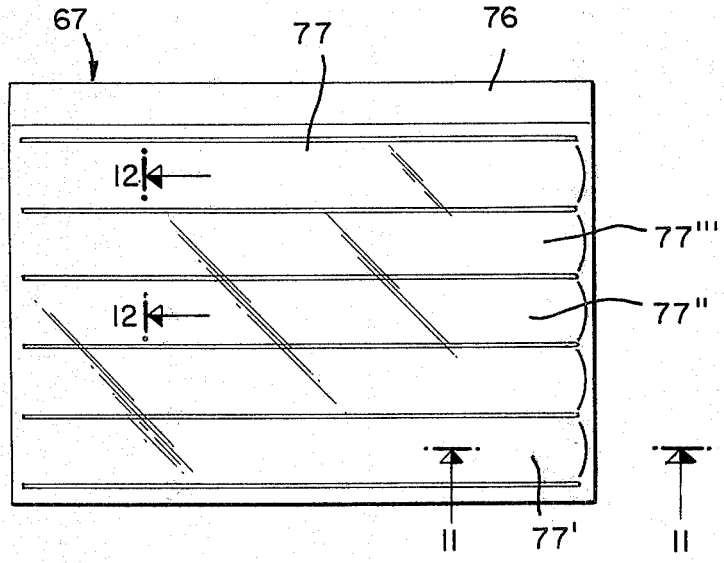
FIG. 10
FIG. 11
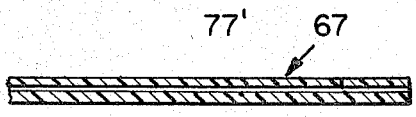
FIG. 12
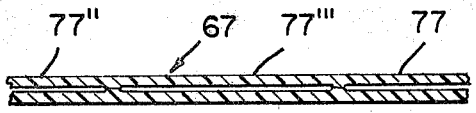
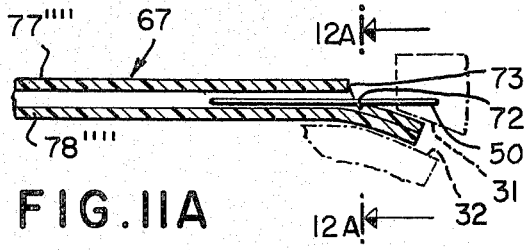
FIG. 11A
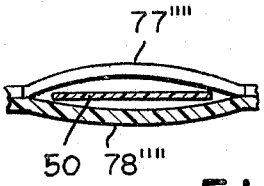
FIG. 12A FIG.13
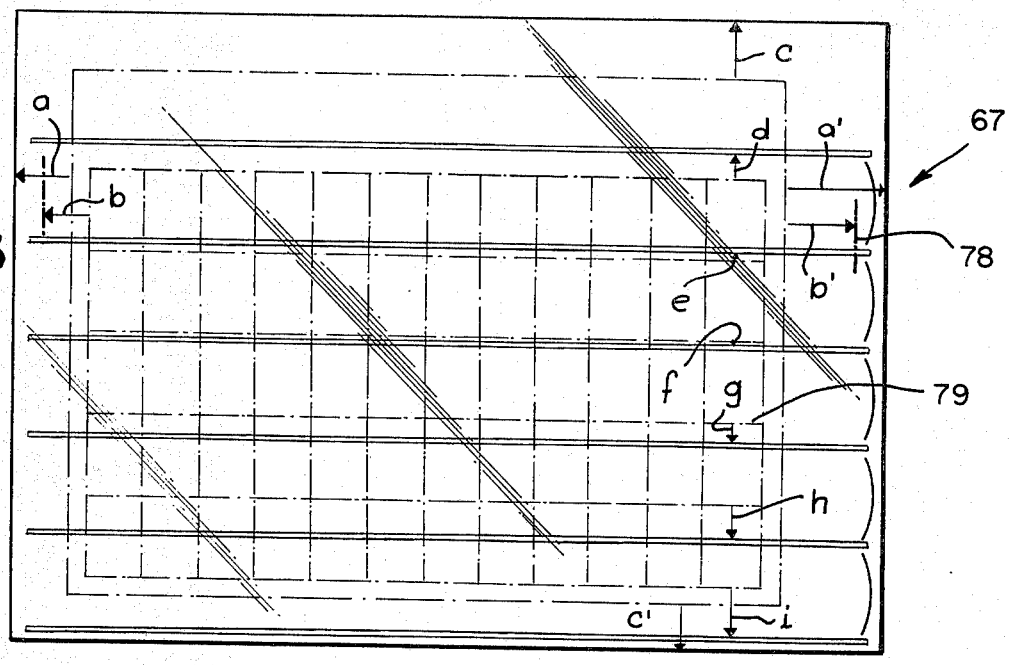
FIG.14
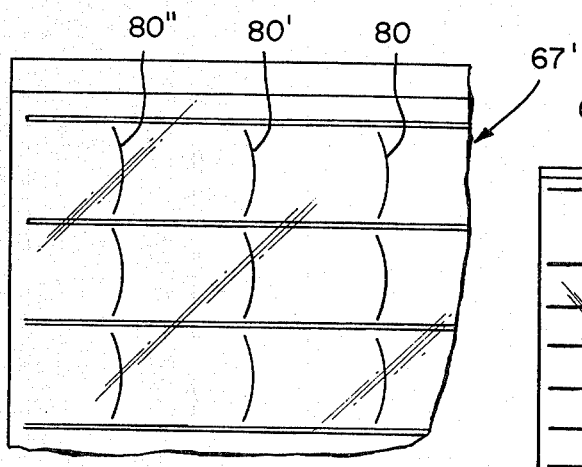
FIG.15
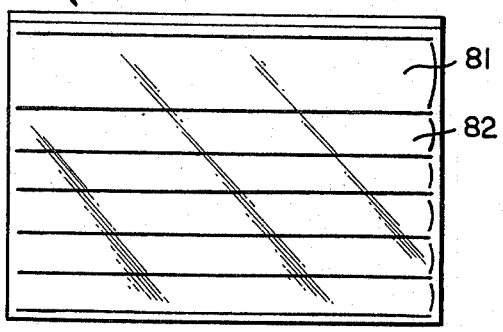
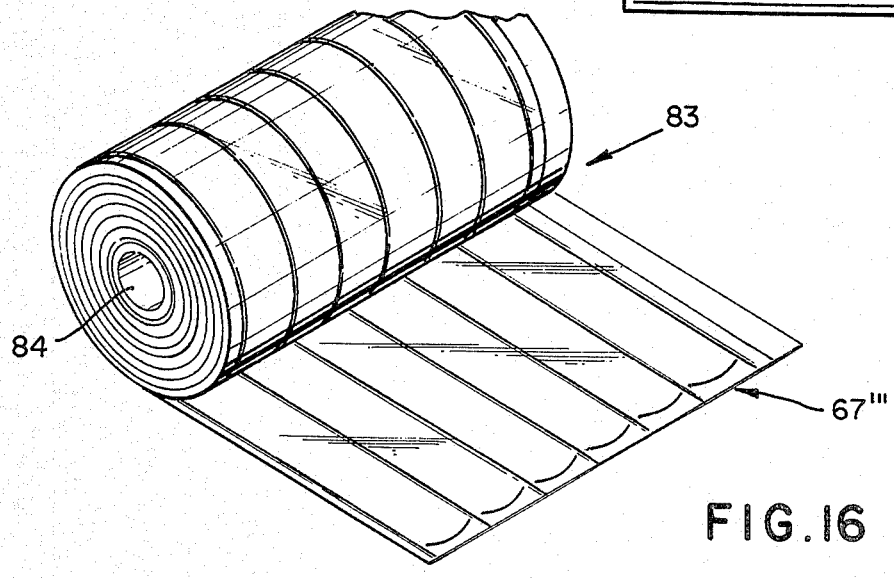
FIG.16

MICROFILM JACKET MICROFILM FEEDING DEVICE AND PROCESS

This invention relates to a novel microfilm jacket support and microfilm insertion apparatus and process.

BACKGROUND OF THE INVENTION

Prior to the present invention there has been no mechanical apparatus for appropriately inserting microfilm strip(s) into microfilm storage jackets, much less on a rapid pace and efficient and fool-proof basis, as well as the cutting of frames of one subject matter from frames of another subject matter heretofore having been a time-consuming laborious job.

SUMMARY OF THE INVENTION

Accordingly, objects of the present invention include the obtaining of an apparatus and process which overcome and/or avoid problems of the types referred to above, together with other novel advantages.

Another object is to obtain a microfilm jacket support and insertion device facilitating the easy insertion of a microfilm strip thereinto.

Another object is to obtain a microfilm jacket support and insertion viewing apparatus.

Another object is to obtain a microfilm jacket support and microfilm frame-severing device.

Another object is to obtain a microfilm jacket support and film insertion advancing device.

Another object is to obtain a novel microfilm jacket having serially arranged film reservoirs as a belt.

Another object is to obtain a reeled microfilm jacket belt for feeding microfilm jackets serially.

Another object is to obtain a process of microfilm insertion into a microfilm jacket.

Other objects become apparent from the preceding and following disclosure.

One or more objects are obtained by the invention as defined in the preceding and following disclosure.

Broadly the invention may be defined as a microfilm jacket microfilm-inserter device including a support which holds the jacket in a predetermined position with a portion of the reservoir defining structure above the insertion opening at a leading end of the jacket extending beyond a pivot point of support of an underface of the jacket, and including a pressure-applying structure as a microfilm jacket edge-flexing mechanism to bend downwardly the unsupported portion of the leading end of the jacket by applying pressure to an upper surface thereof, adapted such that the opening is broadly exposed of the reservoir space whereby a microfilm end insertion is thereby facilitated. In various preferred embodiments as shall be more fully described in the detailed description, there is included as a part of the unitary combination an insertion mechanism for lining-up microfilm to be inserted with the elongated longitudinal axis thereof aligned lineally with the elongated longitudinal axis of the reservoir space into which the microfilm is to be inserted, and additionally a cutting mechanism for cutting related frames from unrelated frames while within the insertion mechanism or adjacent thereto, and additionally an advancing mechanism, and additionally a structure providing for receipt of desired and/or conventional image projection device(s) at a point adjacent to the point of insertion such that the subject matter about to be inserted may be viewed, this also facilitating the combination element for cutting-away a segment since by the viewer one determines where the related subject matter begins and ends and where the next begins. By the present invention, thereby it is possible to efficiently and speedily review film frames of microfilm at the point of insertion into a storage microfilm jacket at the time of severence of the related strip frames from other frames, by a speedy insertion.

In a further improved and preferred embodiment, there is provided a feed reel mechanism and novel serially arranged microfilm jackets having their longitudinal elongated-axis jacket structures arranged end-to-end consecutively as a continuous belt with intermittent insertion openings, and further preferably also with a take-up reel such that the film jacket is not severed at any time but is merely wound upon a further storage reel, or temporary storage further reel before rewinding upon the original feed reel. The reservoirs may also be additionally in parallel.

It is also contemplated that some of the reservoir channels may be broader than others whether or not serially arranged or with parallel arranged reservoirs.

The invention may be better understood by making reference to the following Figures.

THE FIGURES

FIG. 1A illustrates in side elevation view, an alternate embodiment.

FIG. 4 illustrates an in-part view in side view with partial cut-away with one side of the apparatus whereby interior mechanism is viewable.

FIG. 5 illustrates a cross-sectional as taken along lines 5—5 of FIG. 1.

FIG. 5A illustrates an in-part and enlarged view of a particular portion of the FIG. 5 illustration, except in a cutting-of-microfilm state, as it would appear when microfilm strip has been severed.

FIG. 8 illustrates an in-part view in elevation plan of a conventional prior art microfilm jacket with film shown in the process of being inserted thereinto.

FIG. 9 illustrates an in-part view in elevation plan of a novel microfilm jacket according to the present invention, operative with the microfilm jacket jacekt-microfilm feeding device of this invention, and is in the illustrated view easily compared and contrasted to the prior art illustrated in FIG. 8.

FIG. 10 illustrates in its entirety a typical novel microfilm jacket of the present invention in elevation plan view.

FIG. 11 illustrates as in part view in side cross-section as taken along line 11—11 of FIG. 10.

FIG. 11A illustrates a view as taken along lines IIA—11A of FIG. 9, in side cross-sectional in-part view, with the feeding device being shown in phantom for improving understanding of the mechanism of the downward flexing of the leading edge of the microfilm jacket.

FIG. 12 illustrates a view as taken transversely across the width of the microfilm jacket, along lines 12—12 of FIG. 10, in side cross-sectional view.

FIG. 12A illustrates a view extending transversely across the microfilm jacket open mouth in side cross-sectional view as taken along lines 12A—12A of FIG. 11A.

FIG. 13 illustrates typically the microfilm jacket of FIG. 10, shown as lying over an international grid standard sheet, all in elevation plan view.

FIG. 14 illustrates in an in-part view another and further improved microfilm jacket similar to that of FIG. 10, except with a plurality of consecutive mouths for a common channel space extending along between parallel seals.

FIG. 15 illustrates a variation on the embodiment of the FIG. 10, in that at least one of the channels is substantially wider than others of the channels of the microfilm jacket, illustrated in elevation plan view.

FIG. 16 illustrates in an in-part view in perspective view, a roll of microfilm jacket in a continuous elongated jacket-strip otherwide substantially similar to that of the FIGS. 10 and 14 embodiments.

DETAILED DESCRIPTION OF THE INVENTION

In greater detail, all of FIGS. 1, 2, 3, 4, 5, 5A, 6, 6A, 7, 9, 10, 11, 11A, 12, 12A, 13, 14, 15, and 16, relate to the basic common preferred embodiment of the feeding device and microfilm jackets utilizable therewith. The embodiment of FIG. 1A illustrates an alternate feeding mechanism as shall be described in greater detail hereinafter.

In like manner, FIGS. 14 through 16 illustrate alternate embodiments of the novel microfilm jackets.

Figure 1:
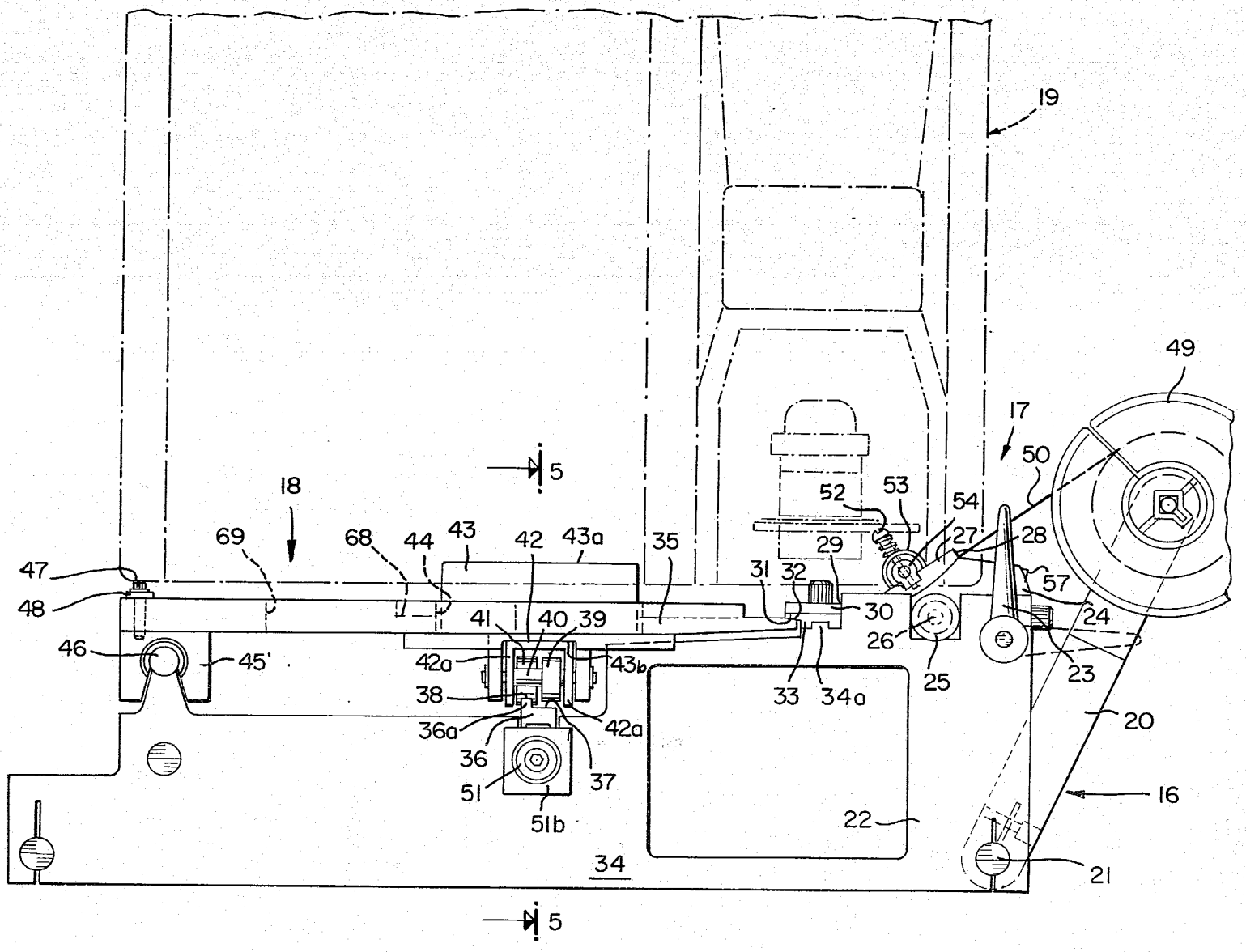
FIG. 1 illustrates in side elevation view a preferred embodiment of the present invention, together with illustrating in phantom the relative mounting position of a microfilm projection apparatus.
Figure 7:
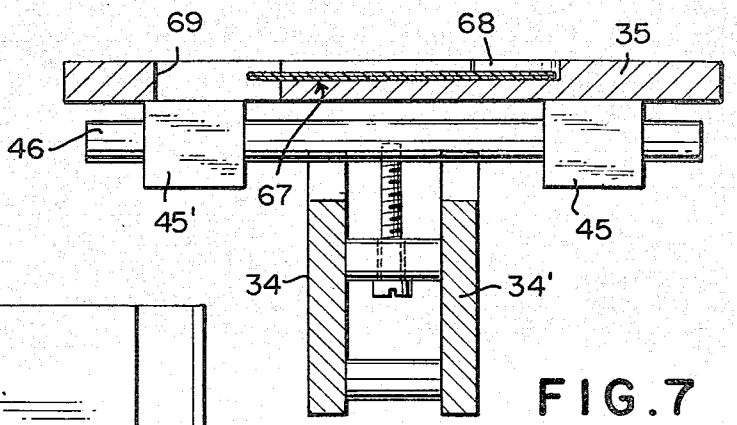
FIG. 7 illustrates a side cross-sectional view as taken along lines 7—7 of FIG. 2.
Figure 2:
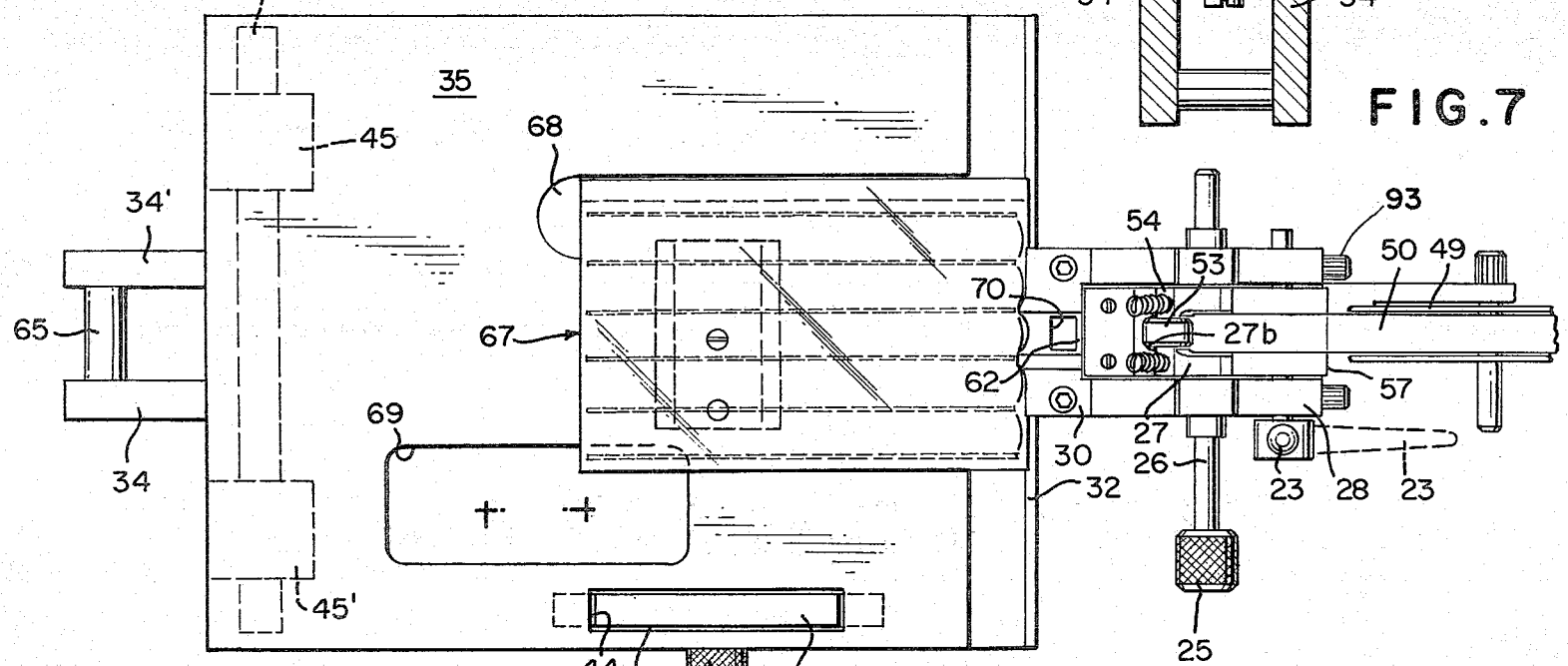
FIG. 2 illustrates an elevation plan view of the embodiment of FIG. 1.
Figure 6A:
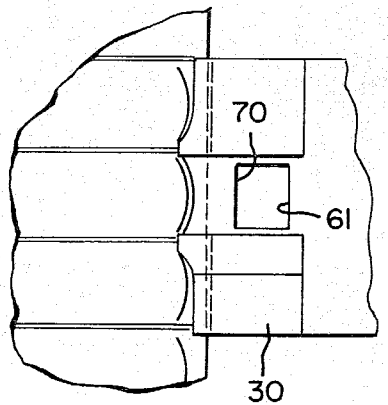
FIG. 6 illustrates a side cross-sectional view as taken along lines 6—6 of the FIG. 1 embodiment.

FIG. 1 illustrates a feeding device 16 of the invention, having a feed and cutter mechanism 17, and a carriage mechanism 18. The feed and cutter mechanism are designed as to receive a microfilm projector 19, for projecting an image, illustrated in phantom. A microfilm support lever 20 is anchored on a shaft 21 within a base support 22. A cutter-iniating handle 23 causes feed and cutter mechanism structure 24 to pivot as shall be described in greater detail below. Handle 25, typically a knob, is utilized typically for revolving to advance microfilm by a turning of a shaft 26 on which shaft also the feed cutter mechanism structure is pivoted. Channel-defining structure 27 defines a microfilm channel seat and mouth 28 for receiving and channeling microfilm, and at location 29 there is a microfilm channel outlet port exit, from which exit microfilm is fed along a channel seat defined adjacent the structure 30 from which channel the microfilm is fed into the open mouth of a microfilm jacket opened by mechanism of the feeding device. In particular, there is an overhang having a lower surface 31, against which upper surface 32 presses, the upper surface 32 being a downwardly inclined surface, and the key 34a coordinating with the key 33 to assure correct alignment.

The upper surface 32 is a part of the overall carriage structure platform 35, pivotably mounted by structure 45 onto a pivot bar 46 with a spring-biased releasable latching lock latchable at any one of alternate positions ranging in directions extending transversely across the width as defined within the structure 36 by the alternate-slot-defining structure 36*a*, and providing a roller track surface 37 for wheel 39 when the carriage platform 35 is being moved laterally from one slot to the other by pressing downwardly on the lever 43*a* in a manner such that the roller 41 becomes lifted pivotably from a slot recess locking position and state to above the surface 38. Structure 42*a* and 42*b* have the wheel 41 mounted thereon while this structure is mounted on the axis 40, secured to spaced-apart flanges extending downwardly from the carriage platform 35. This relationship can be best seen in phantom illustration of FIG. 5, as well as in elevation plan view of FIG. 3. Lower surface 43*b* represents an upper surface between the downwardly-extending flanges, against which upper surface 43*b* the structure 42 normally presses in a locked state as a result of a spring biasing action of a spring viewable in FIG. 5. A lever button 43 while pressing downwardly upon the structure 42, extends upwardly through a through-space 44, in the platform 35. The platform 35 is anchored through an appropriate typically metal strip 48 by an achoring bolt 47 into the mounting structure 45. Reel 49, as a feed reel feeds tape 50 into the channel mouth 28 defined by the structure 27. Anchor structure 51*b* provides for utilization of revolvable handle or knob 51 for adjusting axially along the longitudinal length of the structure 36 the extent to which the carriage is aligned laterally in one direction or the other, for aligning the end portion 32 appropriately such that the particular channel to receive microfilm is precisely positioned before the exit port 29 and channel defined beside the structure 30. Mounting spring-carrying threaded screw or bolt 52 extends through the shaft 54 around which the wheel 53 is rotatably mounted. Accordingly, the shaft 53 is biased by the spring on the bolt 52 into a flush and contacting and rolling relationship with a wheel mounted on the shaft 26, the wheel being fixedly mounted thereon to turn only when the shaft is turned. This relationship is best seen in FIG. 4, in which the opposing relationships of the surfaces of the wheel 53 and the shaft-mounted wheel 55 having surface 56. Position-adjusting bolt 57 adjusts the position at which the pivoting structure 27 normally rests with the channels of feed properly aligned with the ports receiving microfilm therefrom. Accordingly, the bolt 57 has its threaded shaft 57*a* extending through the structure 27, to rest against the structure 22*a*. In FIG. 4, in particular, the spring 58 which biases the pivoted structure upwardly into a stable position is also illustrated. In this Figure, the mouth 59 is also disclosed for the channel 60 having the outlet mouth-defining structure 63 defining the outlet mouth 61, from which the film 50 is fed into a concave channel seat 62 located between structures 30, as for example may be seen in FIG. 7. The structure 64 defines therethrough a through-channel 70 overwhich the microfilm may be brought to rest and through which a light from beneath may be shone upwardly into a lens of a microfilm projector arranged typically as shown in phanton in the FIG. 1 illustration.

Figure 3:
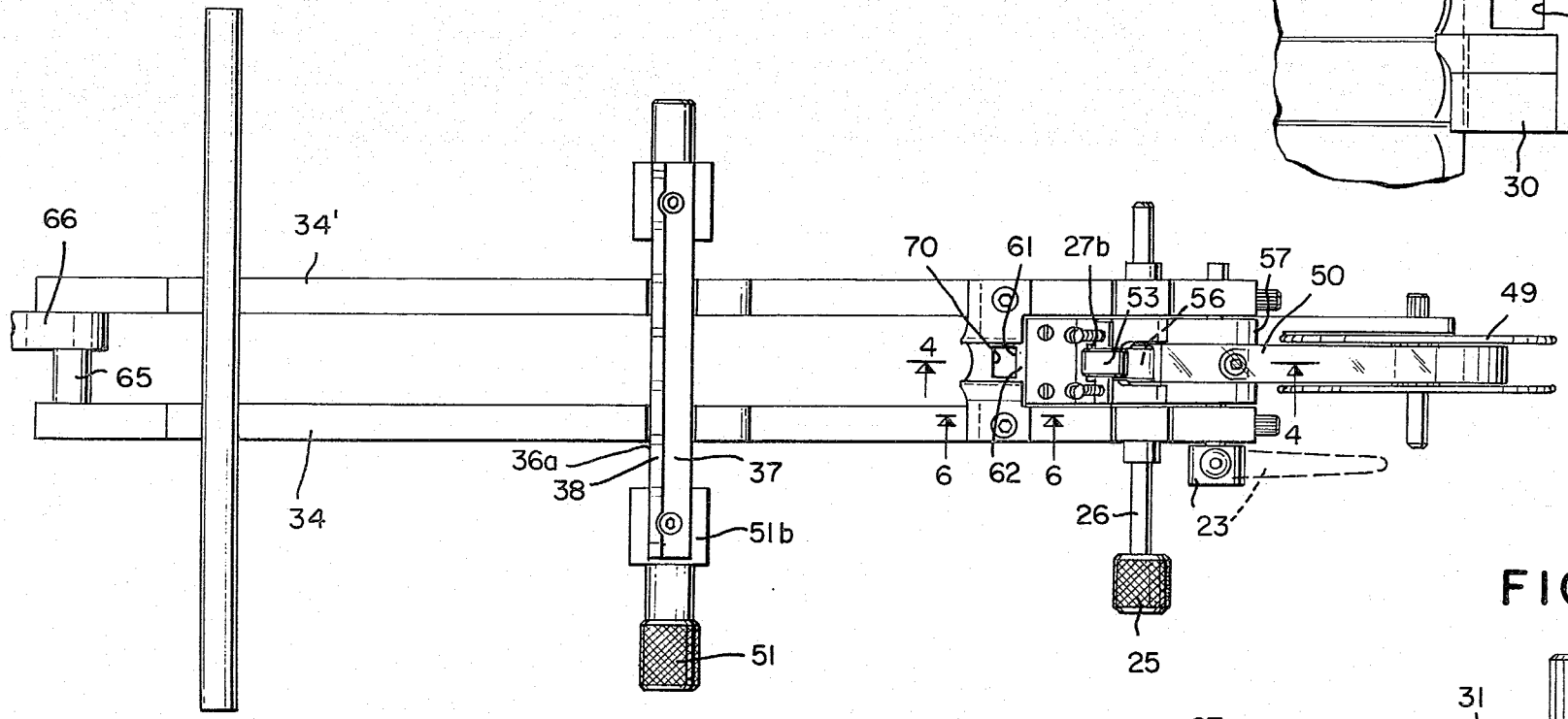
FIG. 3 illustrates an elevation plan view of FIGS. 1 and 2, devoid of the microfilm jacket carriage.
Figure 6:
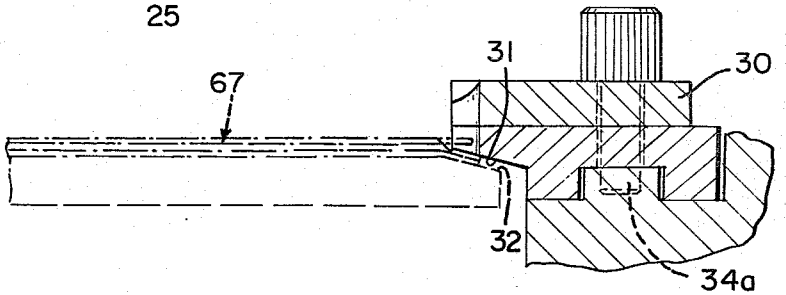

In the FIG. 5 and FIG. 5A illustrations, the channeling position and structure 63 in the open state is viewable, while in the FIG. 5A it is shown after the cutting handle has been pressed typically in a clockwise direction around its pivot point to cause the structure 63 to move downwardly whereby the upwardly concave angular mouth 61 serves to cut the seat 43. Accordingly, the severed film would then be pushed further into a microfilm jacket channel by further advancing the film severed therefrom in a pushing relationship. Spring 95 on knob 93 biases structures 27 & 94. The FIG. 2 embodiment illustrates flanges 34 and 34′ between which is mounted a connector bar 65 for the attaching to other appropriate mechanisms as for example is illustrated in FIG. 3 in which a member 66 is linked thereto by the shaft 65 extending through a through passage therein.

FIG. 9, FIG. 11A, and FIG. 12A, represent insertion details of the microfilm into the novel microfilm jacket of the FIGS. 10, 11, and 12, the FIG. 8 of the prior art being included in order to more clearly point out differences in prior art state of the art and problems and difficulties associated therewith as contrasted to the novel microfilm jacket and inserting device described above. In particular, with reference to the FIG. 8 illustration, a microfilm jacket 67*a* has a channel defined between pancaked sheets joined by ultrasonic seals 75*a' and 75a''*. In order to make insertion reasonably possible and speedy, done heretofore substantially always by hand, the film heretofore had to be inserted by virtue of a cut-out section defining a port 71*a* having a recessed lip 73*a* away from the forward lip 72*a* for insertion of the microfilm 50 thereinto. A particular disadvantage of such a prior art situation is that the microfilm frame 74*a* is left exposed for the frame of a strip on the end thereof last inserted under the conventional system of insertion into such a prior art jacket 67*a*, the trailing end of the strip of film substantially never being pushed totally beneath the upper sheet beyond the cut-out port 71*a*, thereby resulting in soiling and deterioration of the microfilm when the prior art jacket 67*a* was employed, during periods of extended storage and/or use. Moreover, even with the lip recessed in the manner illustrated, in order to provide a ready opening 71*a* for insertion, there never-the-less still remained several problems with the prior art, namely that when the microfilm 50 is in fact inserted, under the conventional and normal modes of storage, the terminal end of the last portion of the film to be pressed inwardly remains exposed on its upper surface, as noted above, in the cut-away port 71*a* by virtue of the recessed lip 73*a;* another difficulty arises from the fact that even with the cut-away, the strip upper and lower sheets of the jacket are held close together thus requiring great care in the insertion by a person, and accordingly taking excessive time to insert each film individually with the personal care of the attendant, to be sure that it is threaded properly between the upper and lower sheets into the channel. Additionally, during the insertion of the leading end of the microfilm 50, great care has to be taken to assure that both of the leading corners become inserted beneath each of the separate angled portions of the lip 73*a;* otherwise one corner may well be threaded beneath the upper half of the lip 73*a* while accidently not being threaded below the upper remaining half, whereby at the converging point of the two half portions the microfilm end would be blocked against further insertion unless withdrawn and begun again, getting both corners beneath the upper sheet.

Accordingly, by reference to the FIG. 9 and FIG. 11a in particular, it may be seen how the microfilm 50 with its frames 74, is inserted beneath the lip edge 73 and above the corresponding lip edge 72 of the microfilm jacket upper sheet 77'''', defining a channel therebeneath between the ultrasonic seals 75' and 75''. The forward lip of the microfilm jacket is in a downwardly flexed state as shown in FIG. 11A as would be effected by virtue of pressure of the lower face 31 of the feed device previously discussed and shown in phantom in this Figure, an upward pressure of the lower lip 32 binding the leading edge of the microfilm jacket and providing for the flexing openly of the mouth thereof to expose the channel for insertion of the film 50 thereinto.

In further pointing out the novelty of the present invention, as compared to the prior art as illustrated typically in FIG. 8, it is important to note that in the embodiments of the present invention as illustrated in FIGS. 9, 10, 11, 11A, 12, and 12A, there is no cut-out providing for insertion of a microfilm, rather there is solely a slit necessary — although it is never-the-less possible to employ with the present inventive feeding mechanism device, the prior art jackets also, the present jackets of the present invention are non-usable by industry in the absence of the novel feeding device of the present invention which provides for the flexing open of the inlet port as shown in FIG. 11A. By virtue of the slits for example as shown in FIGS. 10, and 11, the slit is totally closed to exclude all dust and debris and exposure to the elements when the microfilm is not in the flexed state, thereby totally enclosing all portions of the microfilm including the trailing edge inserted, as well as the present feed-mechanism providing that the severed microfilm strip may be pushed under by the remaining next piece of film being pushed-outwardly to that point and then possibly retracted slightly in order to view the first frame 74. FIG. 12 illustrates a view of the empty channel of FIG. 10 as taken along line 12—12 of FIG. 10. FIG. 12A illustrates a typical appearance of the FIG. 11A embodiment during the state of flexing, viewing the mouth as taken along lines 12A—12A of FIG. 11A. FIG. 13 illustrates a microfilm jacket such as that of the embodiment of FIG. 10, placed over the recently established international standard grid, illustrating the fact that the present inventive microfilm is in accord with the accepted international grid standard, and accordingly the novel feeding device of the present invention is adapted to such a standard and to such a microfilm jacket, and accordingly is preferably tailored to the use of such a jacket. Thus, for the jacket 67, the width of the channels 78 and 79 are equal to one-another and to the width of the international grid channel standard, arrows as *a'*, etc.-through *i* indicating a different scale.

FIG. 14 illustrates an alternate embodiment; instead of having a single mouth at the leading end of the strip, there may be a series of insert slits such as 80, 80', and 80'', etc., for a single channel of any desired predetermined length and numbers of serially consecutive mouths.

FIG. 15 is another preferred embodiment that might be desired for particular customers, in which at least one of the channels is substantially greater in width of the channel as compared to the width of remaining channels, thereby providing for insertion of a microfilm of greater width dimensions as well as microfilm of standard width dimensions in the channels of lesser widths. Accordingly, the channel 81 is substantially greater, approximately twice the normal width, as compared to the normal channel 82.

FIG. 16 illustrates typically microfilm jackets of the present invention of the type illustrated, for example, in FIG. 10, except that this Figure illustrates the novel concept of providing such microfilm jacket in a continuous roll and thus with serially consecutive mouths as in FIG. 14, for roll storage for example on a reel or roller rod before and/or subsequent to insertion of microfilms thereinto the channels thereof. Such a reel or roller roll of this continuous microfilm jacket could, for example, be utilized in the alternate embodiment feeder device illustrated in FIG. 1A by the leading edge of the microfilm jacket 67''' of the roll 83 with its rod-space 84, would be mounted with its microfilm jacket feed reel 85, fed through the grooved guide 86, which guide 86 is a stationary guide on the base 87. The base 87 is provided with alternate position selector 88 along which the carriage selector device 89 rides as a part of the laterally to and fro movable structure 90 carried on the rod 91 of the base 87. The structure 90 carries additionally the jacket take-up support structure 91*a* and reel 92 thereof, while the microfilm is fed from the microfilm feed reel 49*a*, into the feed and cutter mechanism 17*a* which is positioned and works substantially as that described and illustrated for FIG. 1. Accordingly, the primary distinction between the embodiments of FIG. 1 and FIG. 1A, are that in FIG. 1 it is the carriage with platform which is movable laterally to and fro, whereas in the FIG. 1A embodiment, the platform is stationary and it is the feed and cutter mechanism which is movably mounted on a carriage for lateral to and fro movement in order to select the particular channel of a microfilm jacket into which film is to be inserted. The Figure 1A additionally also illustrating, however, the improved and preferred continuous jacket mechanism with the jacket take-up reel 92 within which the reeled microfilm jacket would be stored various strips of the microfilm cut from the initial microfilm 50 that was initially photographed onto film stored on the reel 49*a*.

Thus in each embodiment, the film 50 is caused to advance by mechanically turning the handle or knob 25 to turn the shaft 26 together with its fixedly mounted wheel 55 such that surface 56 opposed by surface 53 of the upper biased wheel, causing the film 50 threaded between the opposing wheel surface to advance into mouth 59 and then out of mouth 61 of a common channel, onto the lower concave seat surface 62. The cutter edge or mouth 61 cuts by downward movement when the structure 27 is pivoted by the cutter handle 23, the edge of surface 62 being the opposing cutting surface, whereby the film strip is severed when the mouth edge 61 is pivoted to a state and position shown in FIG. 5A; prior to such cutting, the leading edge would have been threaded into the opened jacket mouth (slit) by virtue of mounting the leading portion just forward of the mouth such that that leading portion is bent downwardly as shown in FIG. 11A. Thereafter, the handle 25 is further turned, pushing the film well-beneath the lip 73, after which the handle 25 is turned in the reverse counter-clockwise direction to withdraw the leading edge of the uncut remaining feed strip of the microfilm, such that the leading frame may be viewed by positioning above the opening 70 aligned for projection through an accessory projector shown in phantom in FIG. 1. By use of such a projector, the person storing and cutting-off separate independent subject matter from a series of unrelated subjects, is able to determine the last frame for common subject matter to be stored. Heretofore, laborous maneuvering to make such ascertion was required, this being very time-consuming and therefore costly as a prior procedure now made simple by the present feed device and viewing device in combination.

It is within the scope of the present invention to make such modifications and variations and substitutions as would be apparent to a person of ordinary skill.

I claim:

1. A device for inserting microfilm into a microfilm jacket, comprising in combination: jacket support means comprising a platform structure supportable of a microfilm jacket with an insert opening portion of a supported microfilm jacket at a predetermined support-position at substantially a predetermined edge of the platform structure, adapted such that a microfilm jacket edge portion anterior of a supported microfilm jacket's insert opening is suspended substantially without support whereby the microfilm jacket edge portion is susceptible to be flexed in an opening-direction away from and further exposable of its insert opening; and a microfilm inserter means including a film-guiding structure forming feed-path for microfilm and a rearward feed-opening of the film-guiding structure, positioned in a predetermined feed-position relative to and over-lapping said predetermined edge with said feed-path and said rearward feed-opening being alignable with said insert opening of a microfilm jacket supported at said predetermined support position and adapted such that at-least a part of leading structure of the rearward feed-opening of the film-guiding structure thereof are positioned substantially within said insert opening, said microfilm inserter means being for mechanically impelling microfilm toward and in alignment with an insert opening of a supported microfilm jacket at said predetermined support-position; and a cutter means for severing microfilm situated within said feed-path, positioned anterior to and spaced-away from said rearward feed opening; and microfilm jacket edge-flexing means mounted in a fixed position relative to at least one of said jacket support means and said microfilm inserter means, and the microfilm jacket edge-flexing means being for applying pressure to the suspended edge portion of a supported microfilm jacket whereby the suspended edge portion is flexed in said opening direction, and said microfilm jacket edge-flexing means being further for anchoring the suspended edge portion by clamping pressure by said applying pressure whereby a supported microfilm jacket is thereby prevented from shifting and from slipping away from the microfilm inserter means when a film is being inserted from said feed-path into the aligned jacket insert opening.

2. A microfilm jacket film inserter device of claim 1, in which said cutter means includes end-to-end aligned and substantially flushly adjacent channel portions as first and second channel portions of said feed-path, at least one of the first and second channel portions being substantially fixedly mounted relative to the other, and the remaining one thereof being adapted to be movable in a plane transversely to the feed-path whereby microfilm positioned within the feed-path is severable when the remaining one is moved transversely.

3. A microfilm jacket inserter device of claim 2, including intermediate support structure mounted pivotally on the microfilm inserter means and pivotable to and fro forwardly and rearwardly and spring-biased forwardly toward said one of the first and second channel portions, said remaining one being pivotally mounted on said intermediate support structure and being pivotable to and fro upwardly and downwardly relative to said feed-path of said one of the first and second channel portions, adapted such that said remaining one is continuously biased against said one of the first and second channel portions, into a flush and contacting state.

4. A microfilm jacket film inserter device of claim 3, in which the film inserter means includes pincher roller means for advancing film within said channel, the roller means including at least a pair of opposingly mounted rollers mounted rotatably with respective axes of rotation substantially parallel to one-another and positioned for feeding film alignedly along the feed-path.

5. A microfilm jacket film inserter device of claim 4, in which at least one of said jacket support means and said film inserter means is adjustable for lateral movement relative to the other adapted for intemittently aligning different microfilm jacket channels one at a time selectively of a multi-channeled microfilm jacket having a plurality of substantially parallel side-by-side microfilm jacket reservoir channels.

6. A microfilm jacket film inserter device of claim 5, in which for each of multiple intermittent positions of selective positioning of said channels, selective structure is included for predetermined seating in an aligned position for insertion of microfilm into a supported microfilm jacket.

7. A microfilm jacket film inserter device of claim 3, including reel means for feeding from a reel support a series of continuous serially end-to-end microfilm jackets onto said jacket support means to a position aligned for proper functioning of said microfilm jacket edge-flexing means and said film inserter means.

8. A microfilm jacket film inserter device of claim 7, in which the reel means includes both a feed reel mechanism and a take-up reel mechanism, the feed reel mechanism being adapted to feed at least partially empty microfilm serially arranged continuous microfilm jackets onto said support and onward to said take-up reel mechanism intermittently between microfilm-insertion operations, and said take-up reel mechanism being adapted to receive and store at least partially filled microfilm serially arranged continuous microfilm jackets on a take-up reel.

9. A microfilm jacket film inserter device of claim 3, in which said film inserter means includes structure adapted to receive projector means for forming an image from a microfilm frame of a film mounted within said film inserter means.

* * * * *